US009872533B2

(12) United States Patent
Perizzolo et al.

(10) Patent No.: US 9,872,533 B2
(45) Date of Patent: Jan. 23, 2018

(54) INNER SHOE FOR A SKI BOOT

(71) Applicant: FISCHER SPORTS GMBH, Ried/Innkreis (AT)

(72) Inventors: Roberto Perizzolo, Castelcucco (IT); Samanta Francescato, Porcellengo (IT)

(73) Assignee: Fischer Sports GmbH, Ried/Innkries (AT)

( * ) Notice: Subject to any disclaimer, the term of this patent is extended or adjusted under 35 U.S.C. 154(b) by 0 days.

(21) Appl. No.: 14/355,910

(22) PCT Filed: Nov. 2, 2012

(86) PCT No.: PCT/AT2012/000279
§ 371 (c)(1),
(2) Date: May 2, 2014

(87) PCT Pub. No.: WO2013/063630
PCT Pub. Date: May 10, 2013

(65) Prior Publication Data

US 2014/0283414 A1 Sep. 25, 2014

(30) Foreign Application Priority Data

Nov. 2, 2011 (AT) ..... 1613/2011

(51) Int. Cl.
*A43B 3/10* (2006.01)
*A43B 5/04* (2006.01)
*A43B 23/02* (2006.01)

(52) U.S. Cl.
CPC ..... *A43B 5/0405* (2013.01); *A43B 5/0474* (2013.01); *A43B 5/0482* (2013.01); *A43B 23/02* (2013.01)

(58) Field of Classification Search
CPC ... A43B 5/0405; A43B 5/0474; A43B 5/0482; A43B 3/107
USPC ..... 36/10, 116, 118.2
See application file for complete search history.

(56) References Cited

U.S. PATENT DOCUMENTS 1,610,700 A * 12/1926 Morton ..... A43B 5/00 24/31 C
4,258,481 A * 3/1981 Lamb ..... A43B 5/0415 36/118.2
4,523,392 A * 6/1985 Gabrielli ..... 36/10
4,839,973 A 6/1989 Dodge
5,575,015 A * 11/1996 Paris ..... A43B 5/0405 2/240
5,761,830 A * 6/1998 Condini ..... A43B 19/00 36/10

(Continued)

FOREIGN PATENT DOCUMENTS

DE 3715095 A1 11/1987
EP 0674856 A1 10/1995

(Continued)

*Primary Examiner* — Khoa Huynh
*Assistant Examiner* — Katharine Gracz
(74) *Attorney, Agent, or Firm* — Laurence A. Greenberg; Werner H. Stemer; Ralph E. Locher

(57) ABSTRACT

An inner shoe for a ski boot has an upper which has a flexible upper material and is connected via an articulated connection to a sleeve. The sleeve is formed of a sleeve material that is harder than the upper material. A ski boot, in particular formed as an alpine ski boot, includes such an inner shoe.

14 Claims, 6 Drawing Sheets

(56) References Cited

U.S. PATENT DOCUMENTS

| | | | | |
|---|---|---|---|---|
| 5,778,566 | A * | 7/1998 | Edauw | A43B 5/0405 36/10 |
| 6,079,124 | A * | 6/2000 | Dalvy | A43B 19/00 36/10 |
| 6,293,564 | B1 * | 9/2001 | Gabrielli | A43B 5/0405 280/11.224 |
| 6,453,580 | B1 * | 9/2002 | Lancon | A43B 5/0411 36/117.2 |
| 7,293,372 | B2 * | 11/2007 | Nakano | A43B 1/0018 36/102 |
| 7,392,601 | B2 * | 7/2008 | Vattes | A41D 27/28 36/10 |
| 2001/0001908 | A1 * | 5/2001 | Chemello | 36/117.1 |
| 2003/0097766 | A1 * | 5/2003 | Morgan | 36/10 |
| 2005/0102860 | A1 | 5/2005 | Sartor et al. | |

FOREIGN PATENT DOCUMENTS

| | | | |
|---|---|---|---|
| EP | 0692202 | A1 | 1/1996 |
| WO | 03077695 | A1 | 9/2003 |
| WO | 2006077606 | A1 | 7/2006 |

* cited by examiner

INNER SHOE FOR A SKI BOOT

BACKGROUND OF THE INVENTION

Field of the Invention

The invention relates to an inner shoe, in particular an alpine ski boot, with an upper, which comprises a flexible upper material and which is connected to a sleeve.

The invention further relates to a ski boot, in particular alpine ski boot, with a shell, which comprises a bottom shell part, which is pivotably connected to a top shell part via an articulation, wherein provision is made for a locking device, which acts between the top and the bottom shell part, wherein, in an open position of the locking device, the articulation between the bottom and the top shell part is released by the locking device for a pivotability, both in the direction of a front toe section of the shell as well as in an opposite direction and, in a closed position of the locking device, the pivotability of the top shell part is blocked in both directions via the locking device.

U.S. Pat. No. 4,839,973 describes a ski boot and a matching inner shoe comprising a top part, which is supported in an articulated manner on a bottom part comprising an axis.

EP 0 692 202 A1 discloses an inner shoe for sports boots, in particular ski boots, wherein a bottom part is connected to a quarter portion via a flexible, for example a bellows-like connection.

An inner shoe for alpine ski boots is known from AT 413 929 B. Alpine ski boots comprise a hard, shell-like outer shoe, in which the flexible, cushioned inner shoe is arranged. To make it possible to bend the leg forwards, alpine ski boots comprise an articulation in the outer shell. The known inner shoes support the bending movement via the inherent elasticity of the inner shoe material; in addition, provision can be made for bending or folding creases, respectively, which make it easier to bend the inner shoe forwards.

In addition, alpine ski boots comprising a so-called "walk" mechanism are known in the state of the art, in the case of which the pivotability of the top shell part of the alpine ski boot can optionally be released or blocked by the wearer relative to the bottom shell part. By releasing the pivotability, the movability of the wearer's lower leg in the ski boot is limited as little as possible, so as to make it possible to walk normally.

Disadvantageously, however, the known inner shoes are not optimally suitable for a use with such a ski boot. Even though it would be possible to use a particularly flexible inner shoe material, which can also take part in the pivoting of the outer shell when the articulation is released so as to obtain a sufficient movability for the walking mode, it is a disadvantage that the hold in the ski boot is impacted through this. On the other hand, a comparatively hard top section of the upper is desired, so as to provide the inner shoe with sufficient stability for use in sports in response to a blocked pivoting mechanism. In this case, the inner shoe, however, is suitable for a ski boot comprising a "walk" function only to a limited extent, because the inherent elasticity of such a hard top upper is not sufficient to obtain a satisfactory pivotability of the top upper.

BRIEF SUMMARY OF THE INVENTION

Accordingly, the object of the instant invention is to improve the pivotability of the inner shoe of the above-mentioned type without losses for the hold in the inner shoe.

Accordingly, in particular an inner shoe is to be created, which is particularly well suitable for an alpine ski boot comprising a walk function.

This object is solved by means of an inner shoe of the above-mentioned type, in the case of which the sleeve comprises a harder sleeve material than the upper material of the upper, and the upper is connected to the sleeve via an articulated connection.

The sleeve material, which comprises a lower inherent elasticity than the upper material, advantageously improves the hold of the wearer in the inner shoe and the force transfer between the inner shoe and the outer shoe, which is preferably an alpine ski boot. On the other hand, it is ensured by means of the articulated connection between sleeve and upper that a pivotability, which conforms to the outer shoe, is obtained. A comparatively hard sleeve material can thus be used, because the articulated connection—and not the inherent elasticity of the sleeve material—is used primarily for the pivotability of the sleeve relative to the upper.

Due to the articulated or movable connection, respectively, between the upper and the sleeve, in particular a use of the inner shoe with an alpine ski boot, which comprises a "walk" function, can be improved. The flexible, elastic upper material, which can comprise a cushioning, hereby ensures a high wearing comfort, wherein an advantageous thermal insulation is also obtained. The arrangement of the sleeve hereby provides in particular for a reinforcement of a top upper section of the inner shoe, which is provided for resting against the lower leg.

To reinforce the inner shoe above an ankle area, it is advantageous, if the sleeve surrounds a top upper section of the upper at least in sections. Accordingly, the sleeve is arranged at the outside of the top upper section, which is provided for resting against the lower leg. A pivoting of the lower leg can thus be converted into a pivoting of the top upper section relative to the bottom upper section of the inner shoe via the articulated connection between the upper and the sleeve. In response to the use with an alpine ski boot, a particularly advantageous force transfer can be obtained with this between the inner shoe and the outer shoe.

To bend the inner shoe, it is advantageous, if the articulated connection between the upper and the sleeve comprises a pivot axis, which runs substantially perpendicularly to a longitudinal direction of the inner shoe, such that the sleeve can be pivoted in the direction of a front toe section, in particular also in the direction of a heel section, of the upper. The inner shoe can thus also take part in a pivoting movement of the outer shoe, in particular between the shell parts of an alpine ski boot.

For pivot ably linking the sleeve to the upper, it is advantageous, if the articulated connection between the upper and the sleeve comprises at least one connection section, which comprises connection means, and at least one pivot section, which is free from connection means. A seam, in particular sewing seam or a welding seam, for example, can be provided as connection means. In addition or in the alternative, provision can also be made for an adhesive connection. The connection means can furthermore comprise an arrangement of similar fastening elements, in particular rivets, bolts or the like.

To obtain a pivotability of the sleeve, which is as free as possible, in down wards direction, that is, leading away from the toe section, and to hereby avoid a material accumulation of the elastic upper material, it is advantageous, if the pivot section, which is free from connection means, extends at least along the rear side of the inner shoe. The sleeve is arranged so as to be movable relative to the upper in the area of the pivot section. The pivotability of the top upper as compared to known embodiments, in the case of which only the inherent elasticity of the upper material is used, can be increased with this.

To improve the pivotability of the sleeve relative to the upper, it is advantageous, if the pivot section, which is free from connection means, extends forwards from the rear side of the inner shoe into the side surfaces,
preferably substantially to the center of the side surfaces of the inner shoe. The transition between pivot section and binding section preferably runs in the ankle area of the inner shoe in each case.

To obtain a permanent, stable connection between the sleeve and the bottom upper, without impacting the desired pivotability, it is advantageous, if provision is made for an elongated connection section, which comprises a continuous connection means, in particular a seam and/or an adhesive area, or an arrangement of individual connection means, in particular rivets or bolts. The elongated connection section preferably comprises a seam, in particular a sewing seam, which connects the upper to the sleeve. In addition, provision can be made for a sequence of individual connection means in the type of rivets or bolts, which extend in longitudinal direction of the connection section, whereby a fixed connection between the upper and the sleeve is also obtained; the articulated connection is hereby obtained by means of the pivot section, which is free from connection means and which preferably extends forwards from the rear side of the upper into the side surfaces of the inner shoe. The elongated connection section comprises a certain elasticity, by means of which a reset force is effected in an advantageous manner, if the sleeve or the top upper, respectively, is pivoted out of its unstressed position.

To transfer bending forces in response to the pivoting of the inner shoe, it is advantageous, if the elongated connection section runs adjacent the pivot section under an acute angle of inclination to the longitudinal direction of the inner shoe, in particular substantially parallel to the longitudinal direction of the inner shoe, at a side surface of the inner shoe.

To obtain the articulated connection between the upper and the sleeve, provision is made according to an alternative preferred embodiment for the connection section to at least comprise a pivot joint between the upper and the sleeve. Preferably, the pivot joint comprises a pivot pin in a similar form as the articulation between the shell parts of the outer shoe.

To ensure the pivotability of the sleeve according to the anatomy of the foot, it is advantageous, if the joint is arranged at a side surface of the inner shoe.

To obtain a stable arrangement of the sleeve on the upper, it is advantageous, if the joint is arranged substantially in the center at the side surface of the inner shoe.

To provide for a comparatively large pivot angle of the sleeve, provision is made according to a further preferred embodiment for the joint at the side surface to be arranged adjacent to an access opening of the inner shoe.

The object, on which the invention is based, is furthermore solved by means of a ski boot of the above-specified type, in the case of which provision is made for an inner shoe, as described above. As has already been mentioned, the arrangement of an inner shoe comprising an articulated connection between upper and sleeve in a ski boot comprising a "walk" function, is advantageous, because a sufficient forwards pivotability in the direction of the toe section or backwards in the direction of a heel section, respectively, is ensured, so that a comfortable walking is made possible when the articulation of the outer shoe is released.

In the case of a ski boot comprising a walk function, it is particularly advantageous, if a pivot axis of the articulation of the shell runs substantially parallel to a pivot axis of the articulated connection of the inner shoe. Accordingly, the articulated connection between upper and sleeve of the inner shoe is particularly well suited to take part in a pivot movement of the shell-shaped ski boot.

The invention will be explained in more details below by means of exemplary embodiments, which are illustrated in the drawings, but which are not to form a limitation for the invention. In detail,

DESCRIPTION OF THE INVENTION

Figure 1:
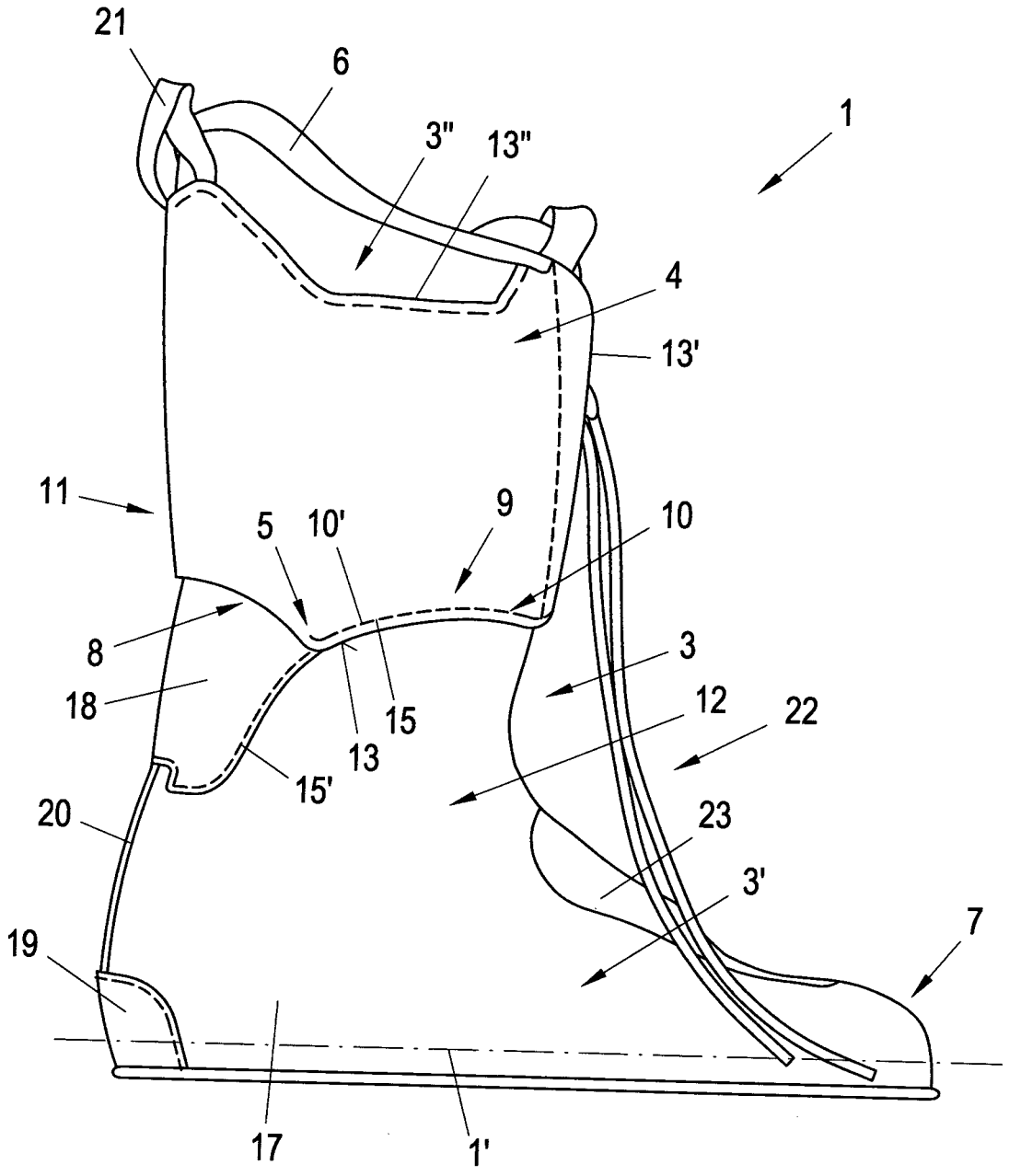
FIG. 1 shows a first embodiment of an inner shoe according to the invention, which comprises an articulated connection between upper and sleeve.
Figure 6:
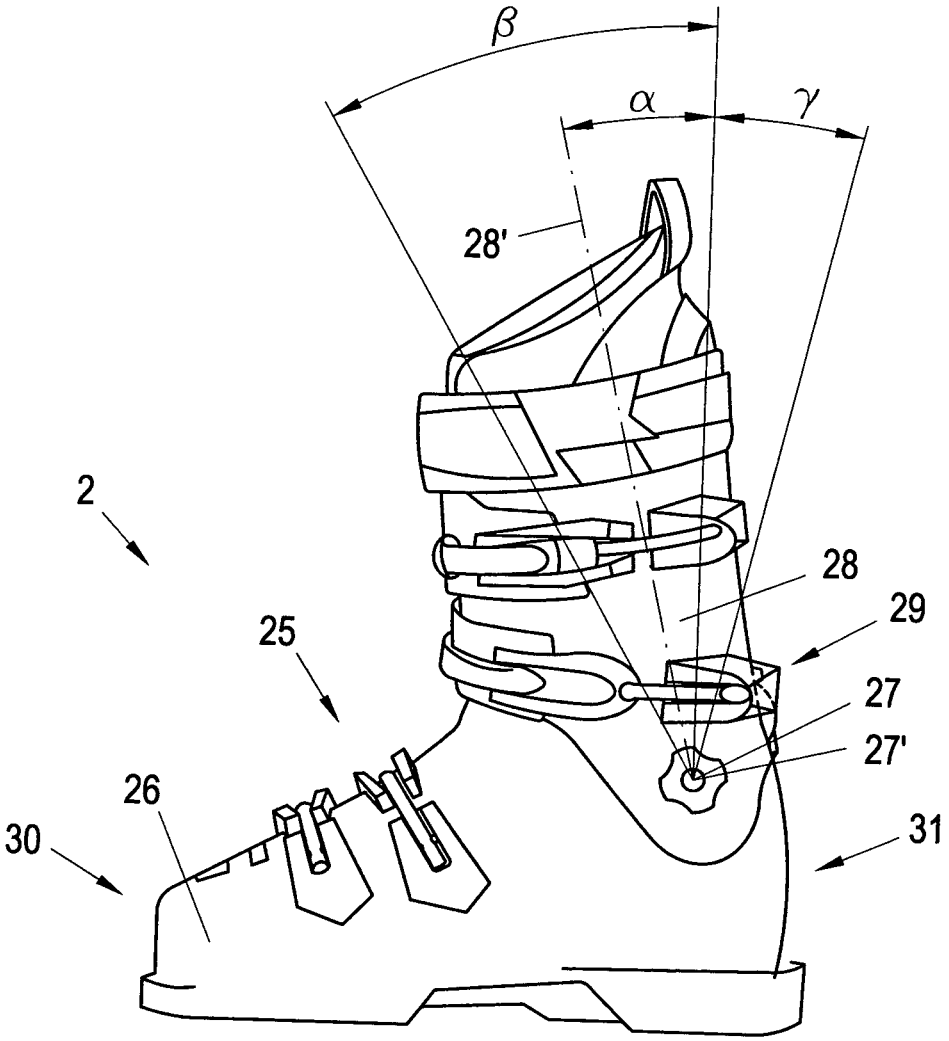
FIG. 6 shows a side view of a ski boot comprising a walk function, in which an inner shoe according to FIGS. 1 to 5 is arranged.

FIG. 1 shows an inner shoe 1 for arrangement within a hard shell of an alpine ski boot 2 (see FIG. 6). The inner shoe 1 comprises an upper 3 comprising a bottom upper section 3', which is provided for accommodating the foot up to the ankle area, and a top upper section 3", which is provided for resting in the area of the lower leg in particular against the calf. The upper 3 comprises a flexible, elastic upper material, which, on the inside, is provided with a cushioning 6, which serves to increase the wearing comfort or to thermally insulate the inner shoe 1, respectively. The upper 3 is connected to a sleeve 4, which partially surrounds the top upper section 3". The sleeve 4 hereby comprises a sleeve material, in particular a hard plastic material, which is harder as compared to the upper material.

In the case of known inner shoes, mainly the inherent elasticity of the inner shoe is used to obtain a pivotability of the top upper part.

In contrast, the upper 3 in the shown embodiment is connected to the sleeve 4 via an articulated connection 5. The pivotability of the upper 3 can be improved with this, which provides advantages in particular in response to use with an alpine ski boot 2 comprising a walk function (see FIG. 6). The articulated connection 5 between the upper 3 and the sleeve 4 provides for advantageous pivotability between the comparatively hard sleeve 4 and the upper section 3'. The sleeve 4 can hereby be pivoted about a pivot axis, which runs substantially perpendicularly to the longitudinal direction 1' of the inner shoe 1, in the direction of a front toe section 7 of the upper 3.

As can further be seen from FIG. 1, the articulated connection 5 comprises a pivot section 8, in which the sleeve 4 is freely movable relative to the adjoining area of the upper 3. With the help of the articulated connection, the sleeve 4 can thus be slid over the soft upper material in the area of the pivot section 8, in particular in response to a pivoting of the lower leg away from the toes or substantially independent therefrom, respectively, can be pivoted to the rear so that a material accumulation of the elastic upper material is avoided. The articulated connection 5 furthermore comprises a connection section 9, which comprises connection means 10 for fastening the sleeve 4 to the upper 3. The pivot section 8, which is free from connections, hereby runs along a rear side 11 of the inner shoe 1. In the shown embodiment, the pivot section 8 extends forwards from the rear side 11 of the inner shoe 1 in the direction of the front toe section 7 into the side surfaces 12 of the inner shoe 1. The end areas of the pivot section 8 are hereby arranged substantially in the center at the side surfaces 12.

As can further be seen from FIG. 1, the elongated connection section 9 comprises an end area, which adjoins the pivot section 8, at every side surface 12. Between the end areas, the connection section 9 runs along a bottom edge 13, a front edge 13', which is arranged adjacent to an access opening 16 (see FIG. 3) of the inner shoe 1, and a top edge 13" of the sleeve 4.

As can further be seen from FIG. 1, the connection section 9 runs along the bottom edge 13 so as to be curved in an arched manner under an acute angle of inclination to the longitudinal direction 1' of the inner shoe 1.

As can further be seen from FIG. 1, the elongated connection section 9 comprises a continuous connection means 10', which is formed by means of a (schematically illustrated) seam 15 in the shown embodiment. The seam 15 preferably comprises at least one sewing seam. The seam 15 hereby continues a seam 15' between a bottom outer part 17 of the upper, which covers the ankle area, and a top outer part 18 of the upper.

In an alternative embodiment (not shown), provision can be made for an arrangement of individual, separate connection means, for example in the type of rivets or bolts, which are arranged along the elongated connection section 9, instead of for continuous connection means 10'.

Figure 2:
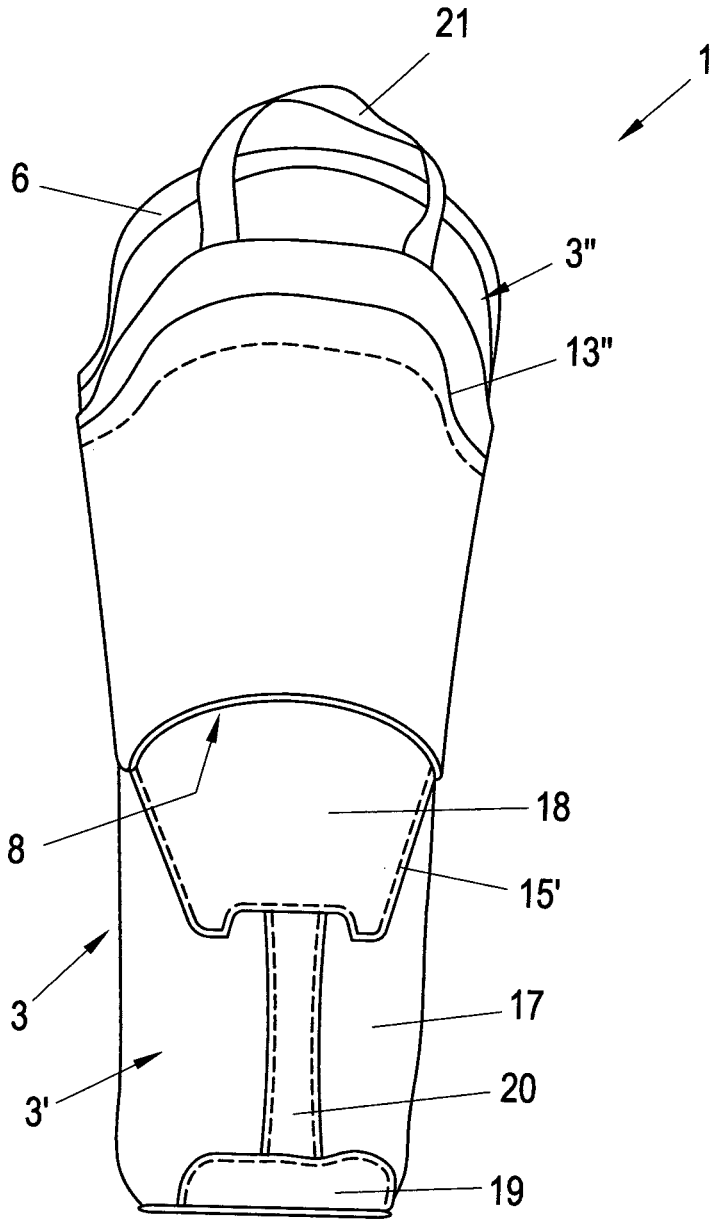
FIG. 2 shows a rear view of the inner shoe illustrated in FIG. 1.

As can be seen from FIGS. 1, 2, the inner shoe 1 comprises a heel cap 19, which is connected to the top upper part 18 via a narrow connection strip 20. The heel cap 19 and the connection strip 20 are in each case sewn to the bottom outer part 17 of the upper. In addition, a loop 21 for removing the inner shoe 1 from the ski boot 2 can be seen schematically from FIG. 2.

Figure 3:
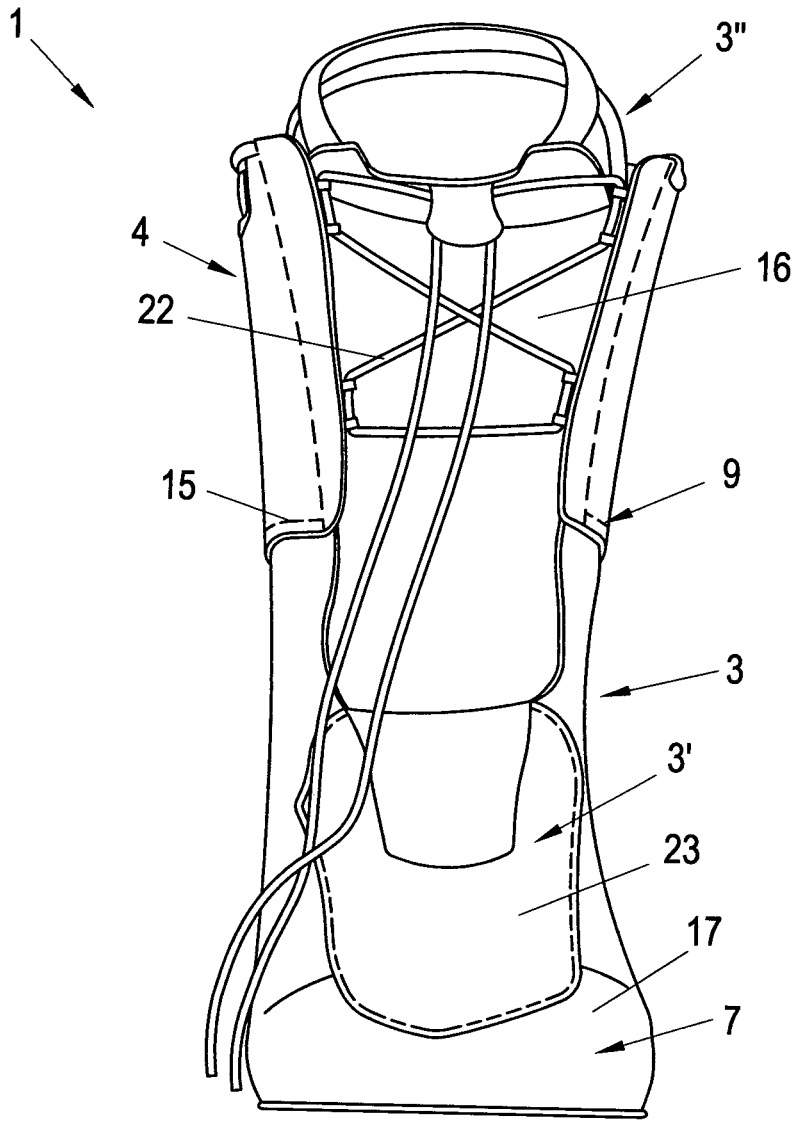
FIG. 3 shows a front view of the inner shoe illustrated in FIG. 1 and FIG. 2.

As can be seen from FIG. 3, provision is made in the area of the access opening 16 for a lacing system 22, by means of which the width of the access opening 16 can be adjusted. In addition, a foot tongue 23 of the upper 3, which connects to the front toe section 7, can also be seen from FIG. 3 (see also FIG. 1).

Figure 4:
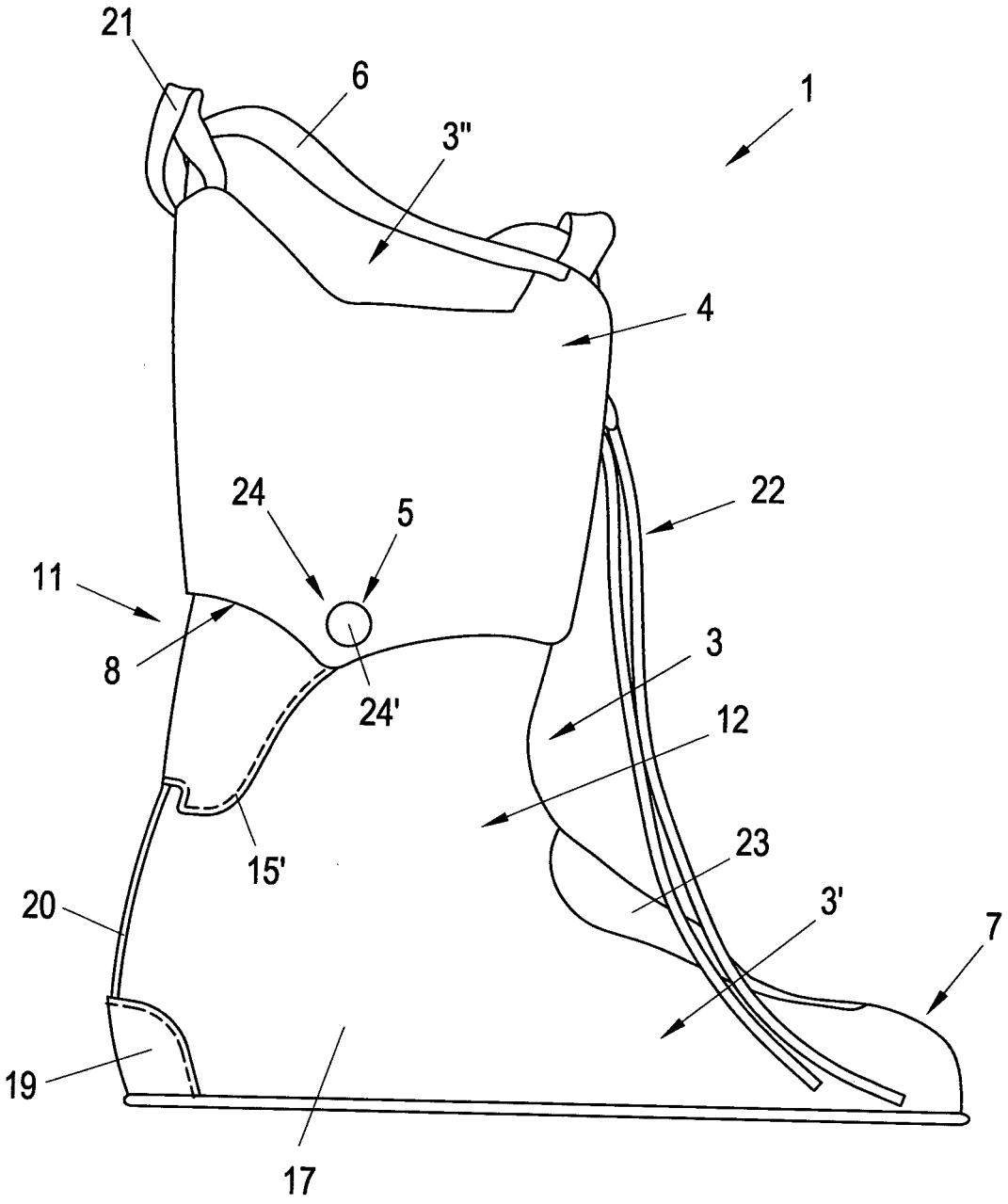
FIG. 4 shows a side view of a further embodiment of the inner shoe according to the invention, in the case of which a joint is arranged in the center at a side surface of the inner shoe.
Figure 5:
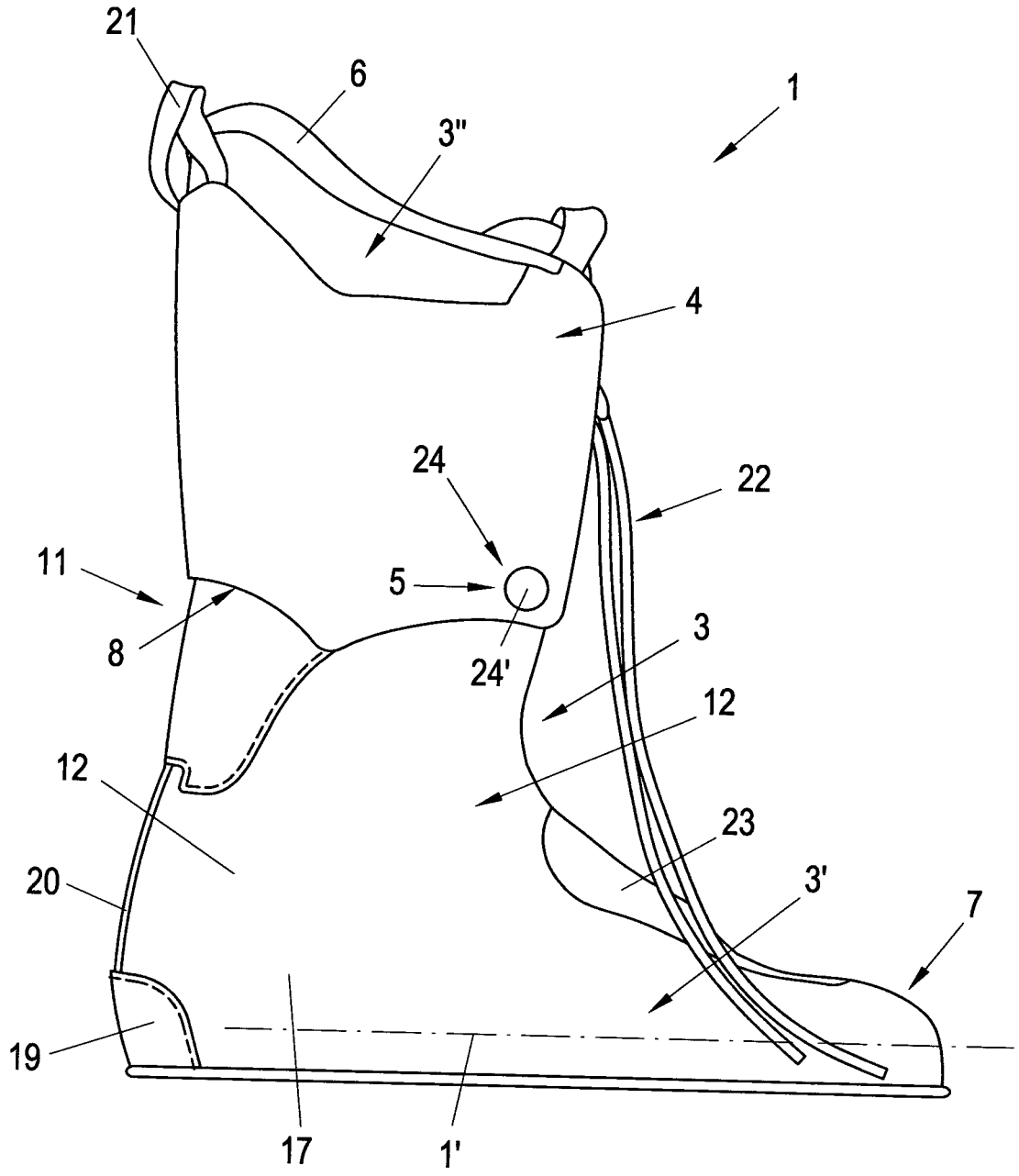
FIG. 5 shows a view of a further embodiment of the inner shoe according to the invention, in the case of which the joint at the side surface is arranged adjacent to an access opening of the inner shoe.

According to FIGS. 4, 5, the connection section 9 of each side surface 12 comprises a pivot joint 24 between the upper 3 and the sleeve 4; provision is made schematically in FIGS. 4, 5 for a disk-shaped joint, which can comprise a pin-shaped or cone-shaped connection part, respectively, for example. The joint 24 defines a pivot axis 24', which runs substantially perpendicularly to the longitudinal direction 1' of the inner shoe 1.

In the embodiment according to FIG. 4, the pivot joint 24 is arranged substantially in the center at the side surface 12 of the inner shoe 1.

A particularly stable articulated connection 5 between upper 3 and sleeve 4 can be obtained through this.

As can be seen from FIG. 5, the joint 24 can, in the alternative, be arranged at the side surface 12 adjacent to the access opening 16 of the inner shoe 1.

FIG. 6 shows an alpine ski boot 2, which comprises the above-described inner shoe 1. The ski boot 2 comprises a shell 25, which is made from a hard plastic material. In a common design, the shell 25 of the ski boot 2 comprises a bottom shell part 26, which is pivotably connected to a top shell part 28 via an articulation 27. Provision is made at the rear side of the ski boot 2 for a locking device 29 (illustrated schematically in FIG. 6), which acts between the top 28 and the bottom shell part 26 and by means of which a so-called "walk" function is obtained.

As can further be seen from FIG. 6, the articulation 27 between the bottom 26 and the top shell part 28 in the shown open position of the locking device 29 is released for a pivotability in the direction of a front toe section 30 of the shell 25 of the ski boot 2 as well as in the direction of a heel section 31. The longitudinal axis 28' of the top shell part 28 of the ski boot 2 is arranged about an angle a to the vertical. In the open position of the locking device 29, the top shell part 28 can be pivoted forwards according to the angle β. In addition, the top shell part 28 can be tilted in the direction of the heel section 31, as is illustrated in FIG. 6 by means of an angle υ. When the locking device 29 is in the closed position, the pivotability of the top shell part 28 is blocked in both directions by means of the locking device 29.

Due to the articulated connection between upper 3 and sleeve 4, the inner shoe 2 illustrated in FIGS. 1 to 5 is particularly well suited to take part in a pivoting of the top shell part 28 of the ski boot 2 in the open position of the locking device 29. For this purpose, the pivot axis 27' of the articulation 27 of the shell 25 runs substantially parallel to the pivot axis 24' of the articulated connection 5 of the inner shoe 1. On the other hand, the hold in the ski boot 2 can be ensured with a non-restricted pivotability of the upper 3 by using a comparatively hard sleeve material.

The invention claimed is:

1. A ski boot, comprising:

a hard outer shell having a top shell and a bottom shell part, and an articulation pivotally connecting said top shell part to said bottom shell part, said outer shell having a walk function for selectively releasing or blocking pivotability of said top shell part relative to said bottom shell part;

an inner shoe including:

an access opening;

an upper formed of a flexible upper material, said upper having a bottom upper section accommodating a foot up to an ankle area, said upper having a top upper section for resting in an area of a lower leg, including the calf;

a sleeve connected to said upper and surrounding said top upper section at least in sections thereof, said sleeve being formed of a harder sleeve material than said upper material of said upper, said sleeve material being configured for a force transfer between said inner shoe and said outer shell, said sleeve, having a bottom edge, a top edge, and a front edges spaced apart from one another, said front edges being adjacent said access opening;

an articulated connection in said top upper section interconnecting said upper to said sleeve, said articulated connection including a pivot section configured to enable said sleeve to be slid over said flexible upper material in an area of said pivot section in response to a pivoting of the lower leg away from the toes with the help of said articulated connection during a pivoting of the upper shell relative to the lower shell in a released position of the walk function, said articulated connection including at least one connection section with a connector, and at least one pivot section that being free from a connector, said pivot section extending at least along a rear side of the inner shoe;

a locking device configured to act between said top shell part and said bottom shell part, said locking device having an open position, wherein the articulation between said bottom shell part and said top shell part is released by said locking device for a pivotability both in a direction of a front toe section of said shell and in an opposite direction, and said locking device having a closed position, wherein the pivotability of said top shell part is blocked in both directions via said locking device.

2. The ski boot according to claim 1, wherein the ski boot is an alpine ski boot.

3. The ski boot according to claim 1, wherein said articulated connection between said upper and said sleeve comprises a pivot axis running substantially perpendicularly to a longitudinal direction of the inner shoe to enable said sleeve to be pivoted in a direction of a front toe section and in a direction of a heel section of said upper.

4. The ski boot according to claim 1, wherein said pivot section that is free from a connector that extends forward from the rear side of the inner shoe into side surfaces of the inner shoe.

5. The inner shoe according to claim 4, wherein said pivot section that is free from a connector that extends substantially to a center of the side surfaces of the inner shoe.

6. The ski boot according to claim 1, which comprises an elongated connection section including a continuous connector selected from the group consisting of a seam, an adhesive area, and an arrangement of individual connectors.

7. The ski boot according to claim 6, wherein said individual connectors are selected from the group consisting of rivets and bolts.

8. The ski boot according to claim 6, wherein said elongated connection section runs adjacent said pivot section under an acute angle of inclination to a longitudinal direction of the inner shoe at a side surface of the inner shoe.

9. The ski boot according to claim 8, wherein said elongated connection section runs substantially parallel to the longitudinal direction of the inner shoe.

10. The ski boot according to claim 1, wherein said connection section comprises at least one joint between said upper and said sleeve.

11. The ski boot according to claim 10, wherein said joint is arranged at a side surface of the inner shoe.

12. The ski boot according to claim 11, wherein said joint is arranged substantially in a center at the side surface of the inner shoe.

13. The ski boot according to claim 10, wherein said joint is arranged at a side surface adjacent an access opening of the inner shoe.

14. The ski boot according to claim 1, wherein said articulation defines a pivot axis running substantially parallel to a pivot axis of said articulated connection of the inner shoe.

* * * * *